US007868553B2

(12) United States Patent
Russell et al.

(10) Patent No.: US 7,868,553 B2
(45) Date of Patent: Jan. 11, 2011

(54) METAL HALIDE LAMP INCLUDING A SOURCE OF AVAILABLE OXYGEN

(75) Inventors: Timothy D. Russell, North Ridgeville, OH (US); Mohamed Rahmane, Clifton Park, NY (US); Peter J. Meschter, Niskayuna, NY (US); Gary W. Utterback, University Heights, OH (US)

(73) Assignee: General Electric Company, Schenectady, NY (US)

( * ) Notice: Subject to any disclaimer, the term of this patent is extended or adjusted under 35 U.S.C. 154(b) by 508 days.

(21) Appl. No.: 11/951,677

(22) Filed: Dec. 6, 2007

(65) Prior Publication Data

US 2009/0146576 A1 Jun. 11, 2009

(51) Int. Cl.
*H01J 61/20* (2006.01)

(52) U.S. Cl. ..... 313/640; 313/637

(58) Field of Classification Search ..... 313/623, 313/627–643, 567, 111–117, 25–27, 318.01–318.09; 439/615, 739; 445/24, 26, 29, 2, 22
See application file for complete search history.

(56) References Cited

U.S. PATENT DOCUMENTS

| | | | | | |
|---|---|---|---|---|---|
| 5,461,281 | A * | 10/1995 | Fromm et al. | ..... | 313/556 |
| 5,668,440 | A * | 9/1997 | Inukai et al. | ..... | 313/635 |
| 5,866,982 | A | 2/1999 | Scott et al. | | |
| 6,069,456 | A * | 5/2000 | Fromm et al. | ..... | 315/248 |
| 6,346,495 | B1 | 2/2002 | Dynys et al. | | |
| 6,356,016 | B1 | 3/2002 | Suijker et al. | | |
| 6,362,571 | B1 | 3/2002 | Suijker et al. | | |
| 6,847,167 | B1 * | 1/2005 | Van Erk | ..... | 313/634 |
| 7,215,081 | B2 | 5/2007 | Bewlay et al. | | |
| 2005/0248279 | A1 * | 11/2005 | Lambrechts et al. | ..... | 313/640 |
| 2006/0164016 | A1 * | 7/2006 | Rintamaki et al. | ..... | 313/638 |
| 2006/0164017 | A1 | 7/2006 | Rintamaki et al. | | |
| 2008/0111489 | A1 * | 5/2008 | Johnston et al. | ..... | 313/640 |

FOREIGN PATENT DOCUMENTS

| | | | |
|---|---|---|---|
| JP | 57 128446 | A | 8/1982 |
| JP | 10 312751 | A | 11/1998 |
| WO | WO 99/53522 | | 10/1999 |
| WO | WO 99/53523 | | 10/1999 |
| WO | WO 99/53523 | A | 10/1999 |
| WO | WO 2005/088675 | | 9/2005 |
| WO | WO 2009/075943 | A | 6/2009 |

* cited by examiner

*Primary Examiner*—Nimeshkumar D Patel
*Assistant Examiner*—Donald L Raleigh
(74) *Attorney, Agent, or Firm*—Fay Sharpe LLP

(57) ABSTRACT

A lamp includes a discharge vessel. Tungsten electrodes extend into the discharge vessel. An ionizable fill is sealed within the vessel. The fill includes a buffer gas, optionally free mercury, a halide component which includes a rare earth halide selected from the group consisting of lanthanum halides, praseodymium halides, neodymium halides, samarium halides, cerium halides, and combinations thereof. A source of available oxygen is present in the discharge vessel. The rare earth halide is present in an amount such that, during lamp operation, in combination with the source of available oxygen, it maintains a difference in vapor phase solubility for tungsten species between a wall of the discharge vessel and at least a portion of at least one of the electrodes.

21 Claims, 6 Drawing Sheets

METAL HALIDE LAMP INCLUDING A SOURCE OF AVAILABLE OXYGEN

BACKGROUND OF THE INVENTION

The present invention relates to a discharge lamp with high lamp lumen maintenance. It finds particular application in connection with a ceramic metal halide (CMH) lamp with a source of available oxygen in the vessel that, during lamp operation, maintains a difference in solubility for tungsten species between the wall and the electrodes, and will be described with particular reference thereto.

High Intensity Discharge (HID) lamps are high-efficiency lamps that can generate large amounts of light from a relatively small source. These lamps are widely used in many applications, including highway and road lighting, lighting of large venues such as sports stadiums, floodlighting of buildings, shops, industrial buildings, and projectors, to name but a few. The term "HID lamp" is used to denote different kinds of lamps. These include mercury vapor lamps, metal halide lamps, and sodium lamps. Metal halide lamps, in particular, are widely used in areas that require a high level of brightness at relatively low cost. HID lamps differ from other lamps because their functioning environment requires operation at high temperature and high pressure over a prolonged period of time. Also, due to their usage and cost, it is desirable that these HID lamps have relatively long useful lives and produce a consistent level of brightness and color of light. Although in principle, HID lamps can operate with either an alternating current (AC) supply or a direct-current (DC) supply, in practice, the lamps are usually driven via an AC supply.

Discharge lamps produce light by ionizing a vapor fill material, such as a mixture of rare gases, metal halides and mercury with an electric arc passing between two electrodes. The electrodes and the fill material are sealed within a translucent or transparent discharge vessel that maintains the pressure of the energized fill material and allows the emitted light to pass through it. The fill material, also known as a "dose," emits a desired spectral energy distribution in response to being excited by the electric arc. For example, halides provide spectral energy distributions that offer a broad choice of light properties, e.g. color temperatures, color renderings, and luminous efficacies.

Such lamps often have a light output that diminishes over time due to blackening of the discharge vessel walls. The blackening is due to tungsten transported from the electrode to the wall. It has been proposed to incorporate a calcium oxide or tungsten oxide oxygen dispenser in the discharge vessel, as disclosed, for example in WO 99/53522 and WO 99/53523 to Koninklijke Philips Electronics N.V. Lamps produced according to the proposals in these applications may not, however, simultaneously meet acceptable lamp efficiency, color point, color stability, lumen maintenance, and reliability values for a commercial lamp.

The exemplary embodiment provides a new and improved metal halide lamp with improved lumen maintenance.

BRIEF DESCRIPTION

In one aspect of the exemplary embodiment, a lamp includes a discharge vessel. Tungsten electrodes extend into the discharge vessel. An ionizable fill is sealed within the vessel. The fill includes a buffer gas, optionally metallic mercury, a halide component that includes a rare earth halide selected from the group consisting of lanthanum halides, praseodymium halides, neodymium halides, samarium halides, cerium halides, and combinations thereof. A source of available oxygen is present in the vessel. The rare earth halide is present in an amount such that, during lamp operation, in combination with the source of available oxygen, maintains a difference in solubility for tungsten species present in a vapor phase between a wall of the discharge vessel and at least a portion of at least one of the electrodes.

In another aspect, a lamp includes a discharge vessel. Tungsten electrodes extend into the discharge vessel. An ionizable fill is sealed within the vessel. The fill includes a buffer gas, optionally mercury, and a cerium halide. The fill also includes at least one of the group consisting of a) an alkali metal halide, b) an alkaline earth metal halide, other than magnesium, and c) a halide of an element selected from indium and thallium. The lamp fill is free of halides of holmium, thulium, dysprosium, erbium, lutetium, yttrium, and ytterbium, terbium, scandium, and magnesium. Tungsten oxide is sealed in the vessel in a sufficient amount to maintain a concentration of $WO_2X_2$ in a vapor phase in the fill during lamp operation of at least $1\times10^{-9}$ μmol/cm$^3$.

In another aspect, a method of forming a lamp includes providing a discharge vessel, providing tungsten electrodes that extend into the discharge vessel, and sealing an ionizable fill within the vessel. The fill includes a buffer gas, optionally metallic mercury, and a halide component comprising a rare earth halide selected from the group consisting of lanthanum halides, praseodymium halides, neodymium halides, samarium halides, cerium halides, and combinations thereof. A source of available oxygen is sealed in the discharge vessel. The source of available oxygen is present in an amount such that the solubility of tungsten species in the fill during lamp operation is lower adjacent at least a portion of one of the electrodes than at a wall of the discharge vessel, such that tungsten from the electrode that would otherwise be deposited on the wall during lamp operation is transported back to one of the electrodes.

One advantage of at least one embodiment is the provision of a ceramic arc tube fill with improved performance and lumen maintenance.

Another advantage of at least one embodiment resides in reduced wall blackening.

Another advantage is that a tungsten regeneration cycle is maintained between a wall of a discharge vessel and a portion of an electrode that is operating at a higher temperature than the wall.

Still further advantages will become apparent to those of ordinary skill in the art upon reading and understanding the following detailed description of the preferred embodiments.

DETAILED DESCRIPTION

Aspects of the exemplary embodiment relate to a fill for a lamp that is formulated to promote a tungsten regeneration cycle by enabling a higher solubility of tungsten species adjacent the wall of the lamp, where deposition would otherwise occur, than at the electrode, even though the electrode operates at a substantially higher temperature than the wall.

Figure 1:
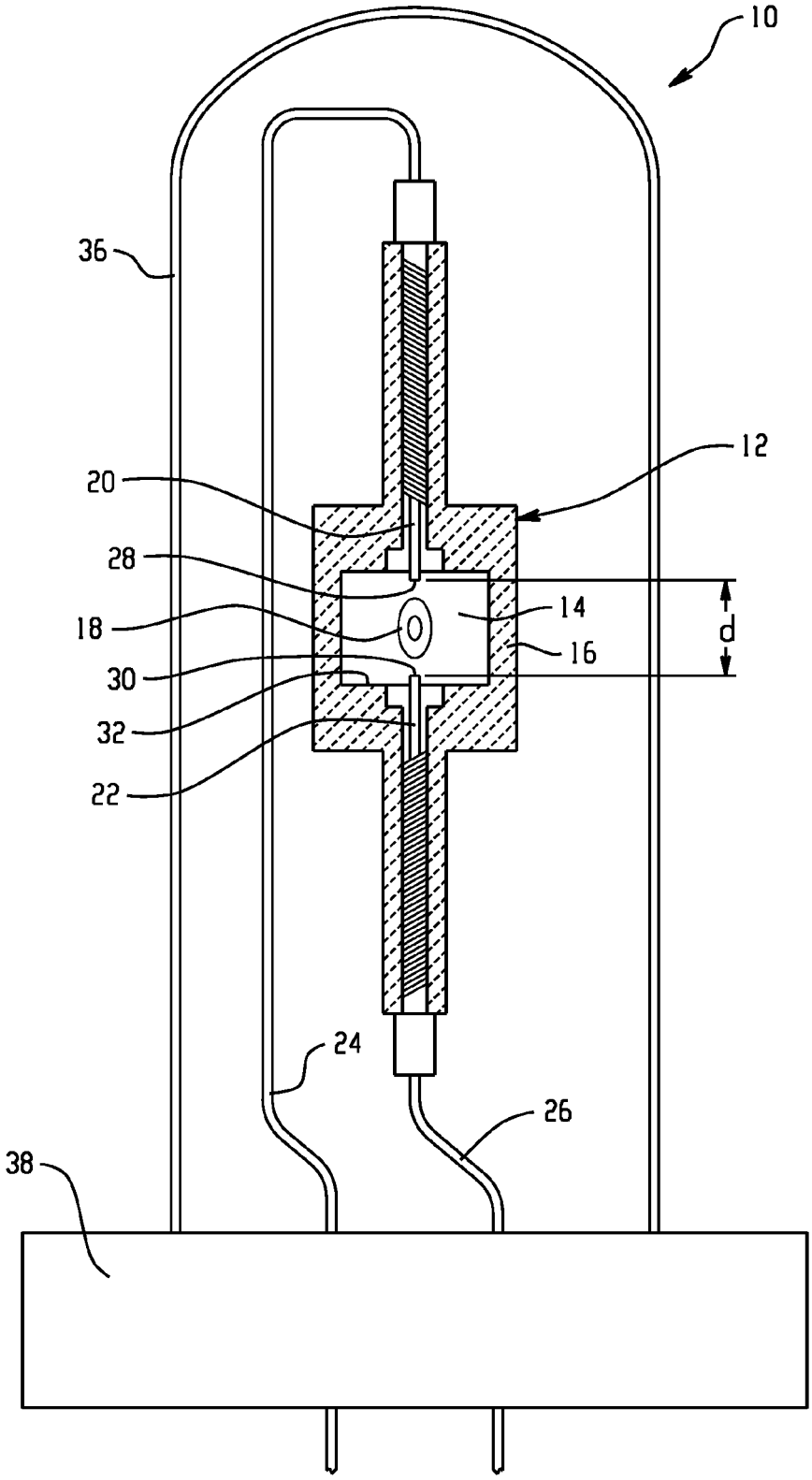
FIG. 1 is a cross-sectional view of an HID lamp according to the exemplary embodiment.

With reference to FIG. 1, a cross-sectional view of an exemplary HID lamp 10 is shown. The lamp includes a discharge vessel or arc tube 12, which defines an interior chamber 14. The discharge vessel 12 has a wall 16, which may be formed of a ceramic material, such as alumina, or other suitable light-transmissive material, such as quartz glass. An ionizable fill 18 is sealed in the interior chamber 14. Tungsten electrodes 20, 22 are positioned at opposite ends of the discharge vessel so as to energize the fill when an electric current is applied thereto. The two electrodes 20 and 22 are typically fed with an alternating electric current via conductors 24, 26 (e.g., from a ballast, not shown). Tips 28, 30 of the electrodes 20, 22 are spaced by a distance d, which defines the arc gap. When the HID lamp 10 is powered, indicating a flow of current to the lamp, a voltage difference is created across the two electrodes. This voltage difference causes an arc across the gap between the tips 28, 30 of the electrodes. The arc results in a plasma discharge in the region between the electrode tips 28, 30. Visible light is generated and passes out of the chamber 14, through the wall 16.

The electrodes become heated during lamp operation and tungsten tends to vaporize from the tips 28, 30. Some of the vaporized tungsten may deposit on an interior surface 32 of wall 16. Absent a regeneration cycle, the deposited tungsten may lead to wall blackening and a reduction in the transmission of the visible light.

While the electrodes 20, 22 may be formed from pure tungsten, e.g., greater than 99% pure tungsten, it is also contemplated that the electrodes may have a lower tungsten content, e.g., may comprise at least 50% or at least 95% tungsten.

The exemplary arc tube 12 is surrounded by an outer bulb 36 that is provided with a lamp cap 38 at one end, through which the lamp is connected with a source of power (not shown), such as mains voltage. The bulb 36 may be formed of glass or other suitable material. The lighting assembly 10 also includes a ballast (not shown), which acts as a starter when the lamp is switched on. The ballast is located in a circuit that includes the lamp and the power source. The space between the arc tube and outer bulb may be evacuated. Optionally a shroud (not shown) formed from quartz or other suitable material, surrounds or partially surrounds the arc tube to contain possible arc tube fragments in the event of an arc tube rupture.

The interior space 14 has a volume commensurate with the operating voltage of the lamp and sustainable wall loading. For example, for a 70 W lamp, the volume may be about 0.15 $cm^3$ to about 0.3 $cm^3$, e.g., about 0.2 $cm^3$, and for a 250 W lamp, the volume may be about 0.5 $cm^3$ to about 2.0 $cm^3$, e.g., about 1.35 $cm^3$.

The ionizable fill 18 includes a buffer gas, optionally mercury (Hg), a halide component, and a source of available oxygen, which may be present as a solid oxide. In some embodiments, the fill may include a source of available halogen. The components of the fill 18 and their respective amounts are selected to provide a higher solubility of tungsten species at the wall surface 32 for reaction with any tungsten deposited there. The halide component includes a rare earth halide and may further include one or more of an alkali metal halide, an alkaline earth metal halide, and a Group IIIA halide (indium and/or thallium halide). In operation, the electrodes 20, 22 produce an arc between tips 28, 30 of the electrodes, which ionizes the fill to produce a plasma in the discharge space. The emission characteristics of the light produced are dependent, primarily, upon the constituents of the fill material, the voltage across the electrodes, the temperature distribution of the chamber, the pressure in the chamber, and the geometry of the chamber. In the following description of the fill, the amounts of the components refer to the amounts initially sealed in the discharge vessel, i.e., before operation of the lamp, unless otherwise noted.

The buffer gas may be an inert gas, such as argon, xenon, krypton, or combination thereof, and may be present in the fill at from about 5-20 micromoles per cubic centimeter (μmol/$cm^3$) of the interior chamber 14. The buffer gas may also function as a starting gas for generating light during the early stages of lamp operation. In one embodiment, suited to CMH lamps, the lamp is backfilled with Ar. In another embodiment, Xe or Ar with a small addition of Kr85 is used. The radioactive Kr85 provides ionization that assists in starting the lamp. The cold fill pressure may be about 60-300 Torr, although higher cold fill pressures are not excluded. In one embodiment, a cold fill pressure of at least about 120 Torr is used. In another embodiment, the cold fill pressure is up to about 240 Torr. Too high a pressure may compromise starting. Too low a pressure can lead to increased lumen depreciation over life. During lamp operation, the pressure of the buffer gas may be at least about 1 atm.

The mercury dose may be present at from about 3 to 35 mg/$cm^3$ of the arc tube volume. In one embodiment, the mercury dose is about 20 mg/$cm^3$. The mercury weight is adjusted to provide the desired arc tube operating voltage (Vop) for drawing power from the selected ballast. In an alternative embodiment, the lamp fill is mercury-free.

The halide component may be present at from about 20 to about 80 mg/$cm^3$ of arc tube volume, e.g., about 30-60 mg/$cm^3$. A ratio of halide dose to mercury can be, for example, from about 1:3 to about 15:1, expressed by weight. The halide(s) in the halide component can each be selected from chlorides, bromides, iodides and combinations thereof. In one embodiment, the halides are all iodides. Iodides tend to provide longer lamp life, as corrosion of the arc tube and/or electrodes is lower with iodide components in the fill than with otherwise similar chloride or bromide components. The halide compounds usually will represent stoichiometric relationships.

The rare earth halide of the halide component is one that is selected in type and concentration such that it does not form a stable oxide by reactions with the optional source of oxygen, i.e., forms an unstable oxide. By this it is meant that it permits available oxygen to exist in the fill during lamp operation. Exemplary rare earth halides which form unstable oxides include halides of lanthanum (La), praseodymium (Pr), neodymium (Nd), samarium (Sm), cerium (Ce), and combinations thereof. The rare earth halide(s) of the fill can have the general form $REX_3$, where RE is selected from La, Pr, Nd, Sm, and Ce, and X is selected from Cl, Br, and I, and combinations thereof. The rare earth halide may be present in the fill at a total concentration of, for example, from about 3 to about 13 μmol/cm$^3$. An exemplary rare earth halide from this group is cerium halide, which may be present at a molar concentration of at least 2% of the halides in the fill, e.g., at least about 8 mol % of the halides in the fill. In one embodiment, only rare earth halides from this limited group of rare earth halides are present in the fill. The lamp fill thus is free of other rare earth halides, by which it is meant that all other rare earth halides are present in a total amount of no more than about 0.1 μmol/cm$^3$. In particular the fill is free of halides of the following rare earth elements: terbium, dysprosium, holmium, thulium, erbium, ytterbium, lutetium, and yttrium. Other halides which form stable oxides are also not present in the fill, such as scandium halides and magnesium halides.

The alkali metal halide, where present, may be selected from sodium (Na), potassium (K), and cesium (Cs) halides, and combinations thereof. In one specific embodiment, the alkali metal halide includes sodium halide. The alkali metal halide(s) of the fill can have the general form AX, where A is selected from Na, K, and Cs, and X is as defined above, and combinations thereof. The alkali metal halide may be present in the fill at a total concentration of, for example, from about 20 to about 300 μmol/cm$^3$.

The alkaline earth metal halide, where present, may be selected from calcium (Ca), barium (Ba), and strontium (Sr) halides, and combinations thereof. The alkaline earth metal halide(s) of the fill can have the general form $MX_2$, where M is selected from Ca, Ba, and Sr, and X is as defined above, and combinations thereof. In one specific embodiment, the alkaline earth metal halide includes calcium halide. The alkaline earth metal halide may be present in the fill at a total concentration of, for example, from about 10 to about 100 μmol/cm$^3$. In another embodiment, the fill is free of calcium halide.

The group IIIa halide, where present, may be selected from thallium (Tl) and indium (In) halides. In one specific embodiment, the group IIIa halide includes thallium halide. The group IIIa halide(s) of the fill may have the general form LX or $LX_3$, where L is selected from Tl and In, and X is as defined above. The group IIIa halide may be present in the fill at a total concentration of, for example, from about 1 to 10 μmol/cm$^3$.

The source of available oxygen is one that, under the lamp operating conditions, makes oxygen available for reaction with other fill components to form $WO_2X_2$. The source of available oxygen gas may be an oxide that is unstable under lamp operating temperatures, such as an oxide of tungsten, free oxygen gas ($O_2$), water, molybdenum oxide, mercury oxide, or combination thereof. The oxide of tungsten may have the general formula $WO_nX_m$, where n is at least 1, m can be 0, and X is as defined above. Exemplary tungsten oxides include $WO_3$, $WO_2$, and tungsten oxyhalides, such as $WO_2I_2$. The source of available oxygen may be present in the fill expressed in terms of its $O_2$ content at, for example, from about 0.1 μmol/cm$^3$, e.g., from 0.2-3 μmol/cm$^3$ and in one embodiment, from 0.2-2.0 μmol/cm$^3$. As will be appreciated, certain oxides do not decompose readily to form available oxygen under lamp operating conditions, such as cerium oxide and calcium oxide, and thus do not tend to act effectively as sources of oxygen. In general, most oxides of rare earth elements are not suitable sources of available oxygen as they are stable at lamp operating temperatures.

In one embodiment, the tungsten electrode is partially oxidized to form tungsten oxide, e.g., a spot on its surface is thermally oxidized prior to insertion into the lamp, to provide the source of available oxygen. In other embodiments, comminuted tungsten oxide, such as tungsten oxide chips, may be introduced in the fill.

The source of available halogen, where present, is generally an unstable halide or other halogen containing compound, which is capable of increasing the concentration of vapor phase $WO_2X_2$, through one or more reactions occurring during lamp operation, where X is as defined above. The source of free halogen may be a compound capable of reacting directly or indirectly with tungsten metal, tungsten-containing species, or a compound of tungsten to form $WO_2X_2$. The source of available halogen may be a halide selected from mercury halides, such as $HgI_2$, $HgBr_2$, $HgCl_2$, and combinations thereof.

In general, the source of free halogen is not a rare earth halide or a halide of indium, thallium, sodium, magnesium, potassium, cesium, calcium, barium, or strontium or any halide that binds the halogen more tightly than tungsten, making it unavailable for reaction. In the case of iodide, the source of available halogen may be present in the fill at a total concentration, expressed in terms of its $I_2$ content of, for example, at least about 0.4 moles/cm$^3$, e.g., from 0.4-7 micromoles/cm$^3$ and in one embodiment, from about 1-3 micromoles/cm$^3$. In the case of $HgBr_2$ and $HgCl_2$ the $WO_2Br_2$ or $WO_2Cl_2$ complex formed during lamp operation is more stable than for the corresponding $WOI_2$ compound, and thus lower amounts of $HgBr_2$ or $HgCl_2$ can be used than for $HgI_2$. The source of available halogen may be present in sufficient quantity to provide an available halogen (e.g., $I_2$ or other reactive halogen species) concentration in the fill, during lamp operation, of at least about 0.4 μmol/cm$^3$.

Where both tungsten oxide and mercury halide are present in the fill, one or both of them may be present at lower amounts than those indicated above. For example tungsten oxide and mercury halide are present in the fill in sufficient amount for the following equation to be satisfied:

$$0.2 \leqq (A+2B) \leqq 12$$

where A is the amount of mercury halide in μmol/cm$^3$, and B is the amount of tungsten oxide, expressed in terms of μmol $O_2$/cm$^3$.

In one embodiment:

$$0.4 \leqq (A+2B) \leqq 6$$

In general the mercury halide and $WO_3$ are present in sufficient amount to allow at least $1\times10^{-9}$ μmol/cm$^3$ of $WO_2I_2$ (as vapor) to be present in the fill during lamp operation (i.e., once tungsten has formed on the wall).

In various embodiments, the lamp fill, when the lamp is formed, i.e. before operation, consists essentially of a buffer gas, optionally free mercury, optionally tungsten oxide, and a halide component consisting essentially of mercury halide, a rare earth halide selected from the group consisting of lanthanum halides, praseodymium halides, neodymium halides, samarium halides, cerium halides, and combinations thereof, and at least one of an alkali metal halide, an alkaline earth metal halide and a halide of an element selected from In and Tl.

Exemplary fill compositions for 70 W and 250 W lamps may be formulated as shown in Table 1, where one or both of $HgI_2$ and $WO_3$ may be present.

TABLE 1

| Fill component | 70 W lamp (μmol/cm$^3$) | 250 W lamp (μmol/cm$^3$) |
|---|---|---|
| Ar | 11.8 | 7.0 |
| Hg | 99.7-149.8 | 73.3 |
| NaI | 105.0-210.0 | 69.8 |

TABLE 1-continued

| Fill component | 70 W lamp (μmol/cm$^3$) | 250 W lamp (μmol/cm$^3$) |
|---|---|---|
| $CaI_2$ | 36.3-72.5 | — |
| $SrI_2$ | — | 49.0 |
| TlI | 3.2-6.4 | 2.5 |
| $CeI_3$ | 4.7-9.3 | 3.2 |
| $HgI_2$ | 0.0-3.0 | 0.0-3.0 |
| $WO_3$ | 0.25-1.0 | 0.25-1.0 |

The fill is formulated to provide conditions which favor regeneration, i.e., favor the solubility of tungsten in the fill 18 at the wall 32 while favoring the redeposition of the solubilized tungsten at the electrode(s) 20, 22. The electrode temperature during lamp operation may be about 2500-3200K at the electrode tip 28, 30, and in one embodiment, is maintained at a temperature of less than about 2700K. Regeneration can be achieved by selecting the lamp fill to provide a higher solubility of tungsten species adjacent the wall than at the electrode tip.

The regeneration is achieved even though the wall 32 of the discharge vessel, where significant tungsten deposition would otherwise occur, is at a lower temperature than the electrode tip 28 or 30 (or other portion of the electrode on which the tungsten is redeposited). For example, the wall may be at a temperature that is at least 200K lower than the portion of the electrode on which redeposition occurs, and in general, is at least 500K lower.

Figure 2:
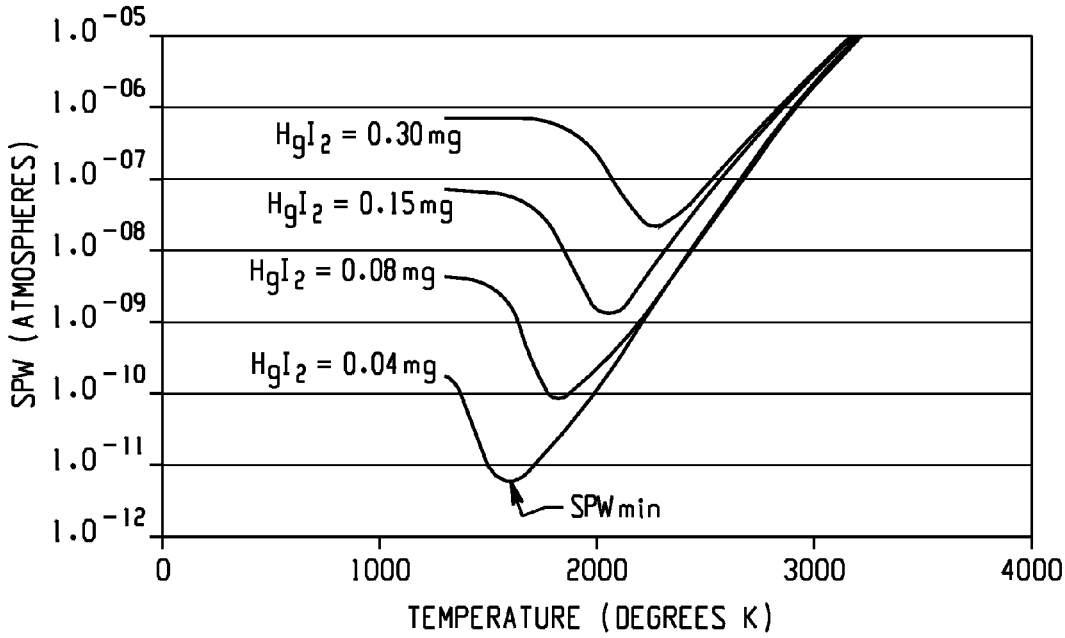
FIG. 2 illustrates theoretical plots of the combined solubility of all tungsten species vs. temperature for different amounts of $HgI_2$ as a source of available halogen, present in an exemplary 0.2 cm$^3$ lamp volume.

FIG. 2 illustrates theoretical thermodynamic calculations for the solubility of tungsten species vs. temperature for different amounts of $HgI_2$ as a source of available halogen present in a 0.2 cm$^3$ lamp volume. SPW represents the summed pressures in atmospheres of all tungsten species present in vapor form. Typically, the tungsten species adjacent the wall 32 is primarily $WO_2I_2$ vapor ad at the electrode 20, 22 may be a mixture of species, such as W, WI, $WI_2$, $WI_3$, $WI_4$, and $WO_2I_2$ vapor. As can be seen from FIG. 2, each plot passes through a trough where the solubility is lowest (e.g., at SPW min.). The present exemplary embodiment takes advantage of this trough by selecting a mercury iodide concentration such that the electrode tip temperature falls closer to the trough, i.e., a lower SPW, than the wall. In general, the SPW at the electrode tip (or wherever on the electrode solubility is lowest) should be no more than 90% of the SPW at the wall to encourage regeneration. Thus, for example, with an $HgI_2$ dose of 0.04 mg, where the wall temperature is about 1300K during operation and the tip temperature is about 2200K, the SPW would be higher at the electrode tip 28, 30 than at the wall 32, and thus regeneration would not be favored. However, when a dose of 0.08 mg $HgI_2$ is used for these temperatures, the trough shifts to higher temperatures and the SPW at the tip 28, 30 is lower than at the wall 32.

Figure 3:
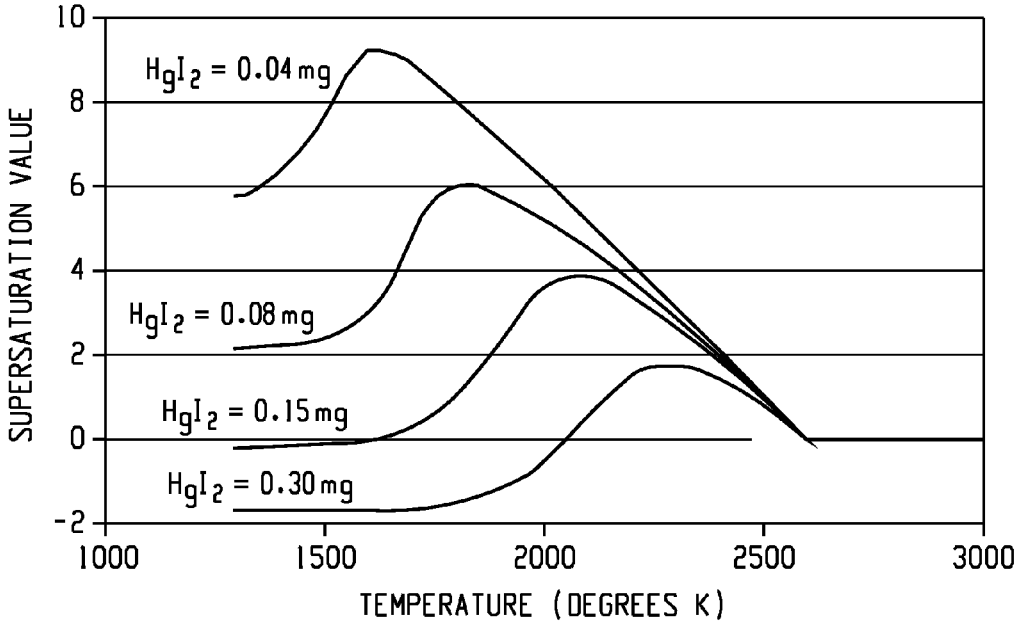
FIG. 3 illustrates theoretical plots of the supersaturation of tungsten species vs. temperature in K for different amounts of $HgI_2$ as a source of available halogen, present in an exemplary 0.2 cm$^3$ lamp volume.

FIG. 3 illustrates theoretical thermodynamic calculations of the supersaturation of tungsten species vs. temperature in K, where $$\text{Supersaturation Value} = \text{Ln}\left[\frac{SPWTe}{SPWTs}\right]$$

Where SPWTe is the SPW at the temperature of the electrodes 20, 22 (2600K) and SPWTs is the SPW at the temperature of the wall surface 32. This means is that if the value is <0, the SPW established by vapor/W equilibrium at the arctube wall, i.e., by vapor in contact with W deposited on the wall, is larger than the SPW for at least one point on the electrode surface, thus there is a driving force for W deposition from the vapor phase to the electrode for at least that one point—and perhaps over wider regions if the value is <0 over a range of electrode temperatures. In general, lower supersaturation values are more favorable, although if the supersaturation value becomes too negative, it may be undesirable. Values within the range shown in FIG. 3 are generally acceptable, however.

Figure 4:
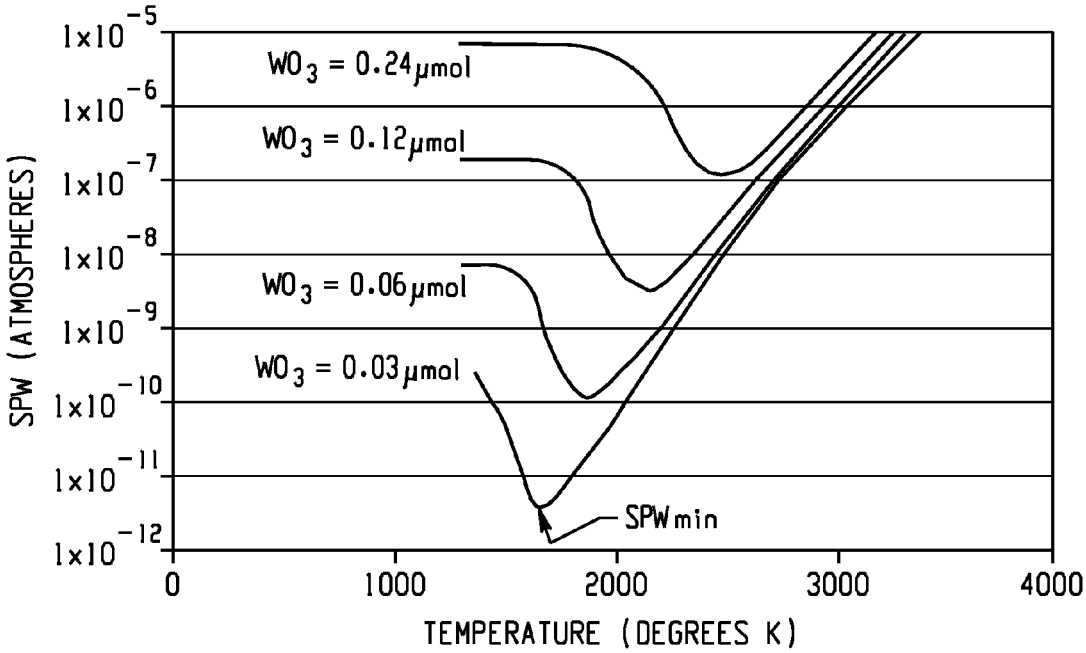
FIG. 4 illustrates theoretical plots of the combined solubility of all tungsten species vs. temperature for different amounts of $WO_3$ as a source of available oxygen, present in the fill of an exemplary lamp with a 0.2 cm$^3$ lamp volume.
Figure 5:
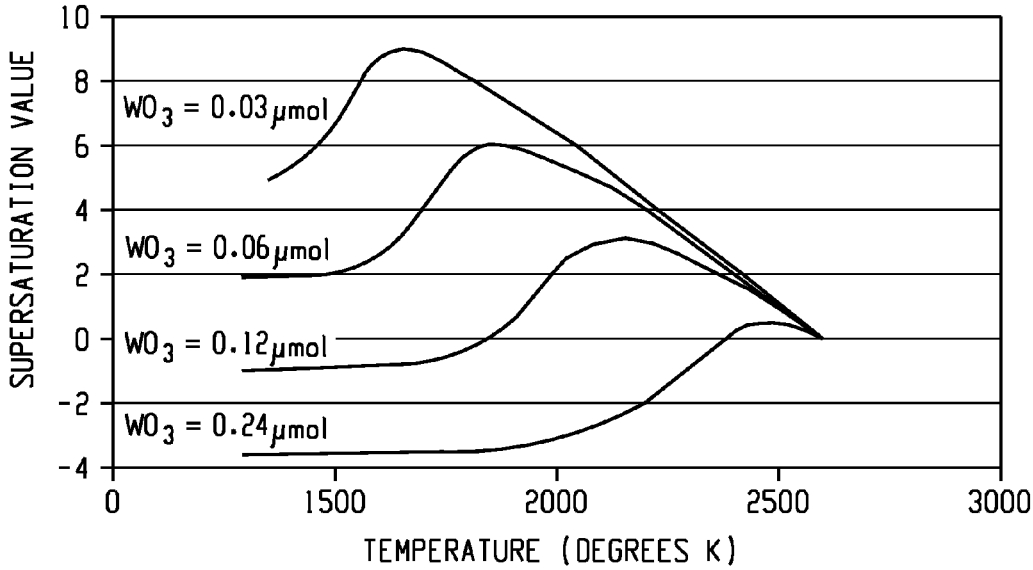
FIG. 5 illustrates theoretical plots of the supersaturation of tungsten species vs. temperature in K for different amounts of $WO_3$ as a source of available oxygen, present in the fill of an exemplary 0.2 $cm^3$ lamp volume.

FIG. 4 shows similar thermodynamically derived plots to FIG. 2, but shows the tungsten solubility for various amounts of $WO_3$ added to the fill as a source of available oxygen. Here also, each of the plots has a trough and the plots can be exploited to ensure that the SWP at the wall exceeds that at the electrode. FIG. 5 is a similar theoretical plot to FIG. 3, but for $WO_3$.

Knowing the temperature of the arc tube wall 32 in the region where blackening due to tungsten deposition is most likely to occur and the temperature of the electrode tip 28, 30, in lamp operation, a suitable amount of $HgI_2$ or $WO_3$ can be determined which favors regeneration while minimizing the effect on other lamp properties. While the plots consider $HgI_2$ and $WO_3$ independently, it will be appreciated that similar plots could be created for combinations of $HgI_2$ and $WO_3$ and appropriate amounts of the two compounds selected.

Without being bound by any particular theory, it is believed that $HgI_2$ and $WO_3$ both lead to an increase in $WO_2I_2$ and $HgI_2$ in the vapor and thus are capable of decreasing W supersaturation and increasing wall cleaning. It is believed that $HgI_2$ reacts with $Al_{11}CeO_{18}$ (formed by reaction of alumina in the arc tube wall with $CeI_3$ in the fill) and with the deposited W to form $WO_2I_2$. In the case of $WO_3$, this reacts with $CeI_3$ to form $WO_2I_2$ and $HgI_2$.

Figure 6:
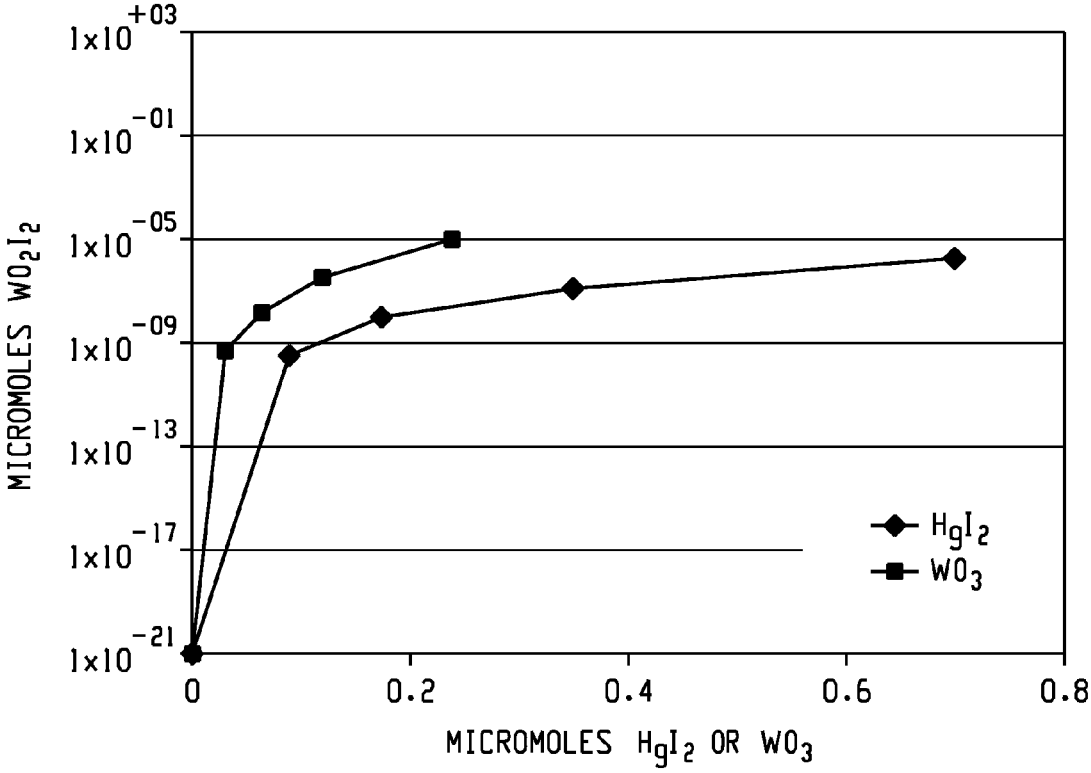
FIG. 6 shows theoretical plots for a lamp with a 0.2 lamp volume illustrating the amount of $WO_2I_2$ in vapor form at the equilibrium state vs. the amount of $HgI_2$ or $WO_3$ added.
Figure 7:
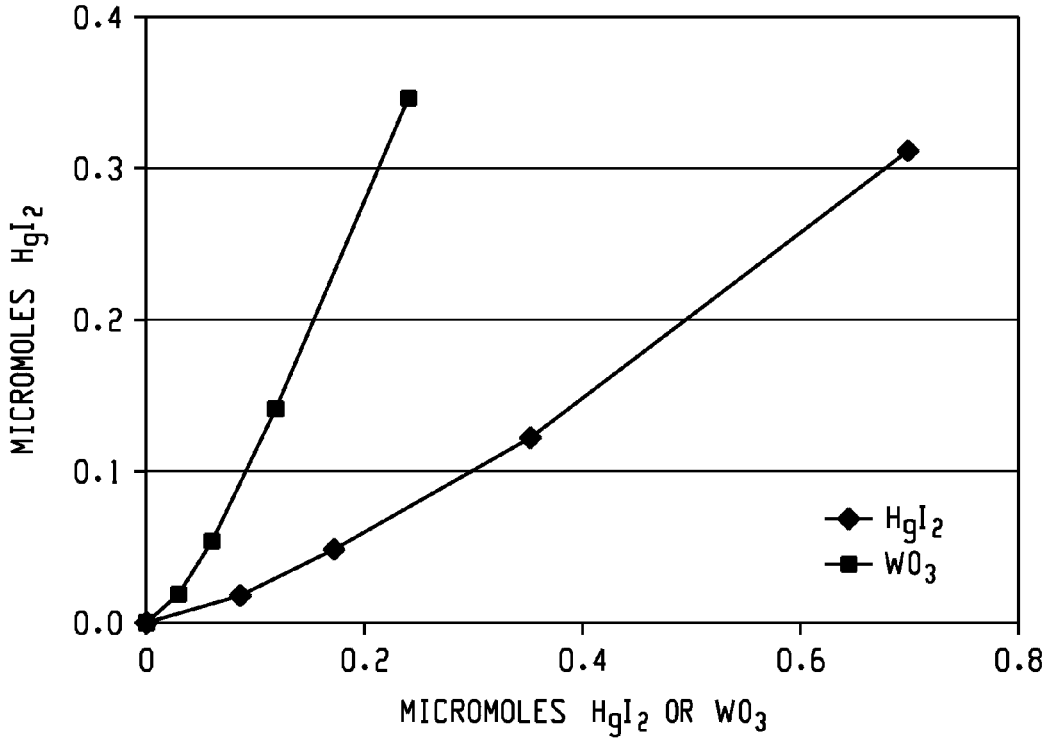
FIG. 7 shows theoretical plots showing the amount of $HgI_2$ in vapor form at the equilibrium state vs. the amount of $HgI_2$ or $WO_3$ added.

By way of example, FIG. 6 shows theoretical plots for a 0.2 cm$^3$ lamp volume illustrating the amount of $WO_2I_2$ in vapor form vs. the amount of $HgI_2$ or $WO_3$ added. FIG. 7 shows a similar theoretical plot showing the amount of $HgI_2$ in vapor form vs. the amount of $HgI_2$ or $WO_3$ added. As can be seen, both of these additives lead to formation of $HgI_2$ and $WO_2I_2$ in the equilibrium state.

Because $WO_3$ tends to reduce the amount of $CeI_3$ present in the fill, the concentration of $WO_3$ in the fill, in general, should not be so high that it impacts the color rendering of the lamp significantly. Additionally, in vertically operating lamps where a temperature gradient exists between the electrodes, it is desirable to avoid high concentrations of tungsten oxide to avoid excessive transport of tungsten between the two electrodes 20, 22.

In various aspects, the ballast is selected to provide the lamp, during operation, with a wall loading of at least about 30 W/cm$^2$. The wall loading may be at least about 50 W/cm$^2$, and in some embodiments, about 70 W/cm$^2$, or higher. Below about 25-30 W/cm$^2$, the arc tube walls tend to be too cool for efficient maintenance of the active tungsten halogen cycle. As defined herein, the arc tube wall loading (WL)=W/A where W is the total arc tube power in watts and A is the area in cm$^2$ of the arc tube wall which is located between the electrode tips 28, 30. The arc tube power is the total arc tube power including electrode power. In general the dose and wall loading are sufficient to maintain a wall temperature of at least about 1000K, e.g., 1000-1400K.

The ceramic metal halide arc tube 12 can be of a three part construction, and may be formed, for example, as described, for example, in any one of U.S. Pat. Nos. 5,866,982; 6,346,495; 7,215,081; and U.S. Pub. No. 2006/0164017. It will be appreciated that the arc tube 12 can be constructed from fewer or greater number of components, such as one or five components. The parts are formed as green ceramic and bonded in a gas tight manner by sintering or other suitable method. An exemplary arc tube can be constructed by die pressing, injection molding, or extruding a mixture of a ceramic powder and a binder into a solid cylinder. The ceramic powder may comprise high purity alumina ($Al_2O_3$), optionally doped with magnesia. Other ceramic materials which may be used include non reactive refractory oxides and oxynitrides such as yttrium oxide, lutetium oxide, and hafnium oxide and their solid solutions and compounds with alumina such as yttrium-aluminum-garnet and aluminum oxynitride. Binders which may be used individually or in combination include organic polymers such as polyols, polyvinyl alcohol, vinyl acetates, acrylates, cellulosics and polyesters. Subsequent to die pressing/extrusion, the binder is removed from the green part, typically by thermal pyrolysis, e.g., at about 900-1100° C., to form a bisque-fired part. The sintering step may be carried out by heating the bisque-fired parts in hydrogen at about 1850-1880° C. The resulting ceramic material comprises a densely sintered polycrystalline alumina.

In other embodiments, the arc tube is formed of quartz glass and can be formed of one piece.

The exemplary lamp finds use in a variety of applications, including highway and road lighting, lighting of large venues such as sports stadiums, floodlighting of buildings, shops, industrial buildings, and in projectors.

Without intending to limit the scope of the present invention, the following example demonstrates the formation of lamps with improved lumen maintenance.

EXAMPLE

Arc tubes 12 were formed according to the shape shown in FIG. 1 from three component parts. The internal volume was 0.2 $cm^3$. The lamps were each filled with a fill as shown in Table 2. The fills of exemplary lamps B, C, D, and F also contained Hg (137 μmol/$cm^3$), NaI (107 μmol/$cm^3$), $CaI_2$ (38 μmol/$cm^3$), TlI (3 μmol/$cm^3$) Ar (12 μmol/$cm^3$). Lamps A and E had fills similar to the exemplary lamps, but with no $HgI_2$ or $WO_3$.

TABLE 2

| Test | $HgI_2$ | $WO_3$ |
|---|---|---|
| A (Control for B, C and D) | — | — |
| B | 0.04 mg (0.4 μmol/$cm^3$) | — |
| C | 0.16 mg (1.6 μmol/$cm^3$) | — |
| D | — | 0.064 mg (1.4 μmol/$cm^3$) |
| E (control for F) | — | — |
| F | 0.3 mg (0.3 μmol/$cm^3$) | |

The lamps were run in a standard burning cycle (11 hrs. on followed by 1 hour off) for extended periods in a horizontal orientation (i.e., at 90 degrees to that illustrated in FIG. 1) on a ballast at 70 W.

Table 3 shows the results obtained after 100 hs. V is the burning voltage. Lumens is the lumen output of the lamp. X color and Y color are the chromaticity X and Y, respectively, on a standard CIE (Commission Internationale de l'Eclairage) chromaticity diagram in which the chromaticity coordinates X and Y represent relative strengths of two of the three primary colors. CRI is the color rendering index, and is a measure of the ability of the human eye to distinguish colors by the light of the lamp, higher values being favored. CCT is the correlated color temperature of the lamp which is the color temperature of a black body which most closely matches the lamp's perceived color. dCCy is the difference in chromaticity of the color point, on the Y axis (Y color), from that of the standard black body curve. The results are the mean of about 5 lamps. As can be seen from Table 3, the exemplary lamps B, C, D, and F have good characteristics, as compared with the control lamps.

TABLE 3

| Test | V | Lumens | X Color | Y Color | CRI | CCC | dCCy |
|---|---|---|---|---|---|---|---|
| A | 102.5 | 7300 | 0.4203 | 0.4004 | 87.6 | 3273 | 0.0029 |
| B | 106.4 | 7453 | 0.4139 | 0.4021 | 88.2 | 3411 | 0.0073 |
| C | 112.9 | 7024 | 0.4264 | 0.3959 | 90.3 | 3116 | −0.0043 |
| D | 117.6 | 6506 | 0.4434 | 0.3873 | 90.0 | 2757 | −0.0187 |
| E | 93.5 | 7476 | 0.4124 | 0.4000 | 84.3 | 3423 | 0.0058 |
| F | 110.3 | 6915 | 0.4263 | 0.3881 | 88.8 | 3058 | −0.0119 |

Figure 8:
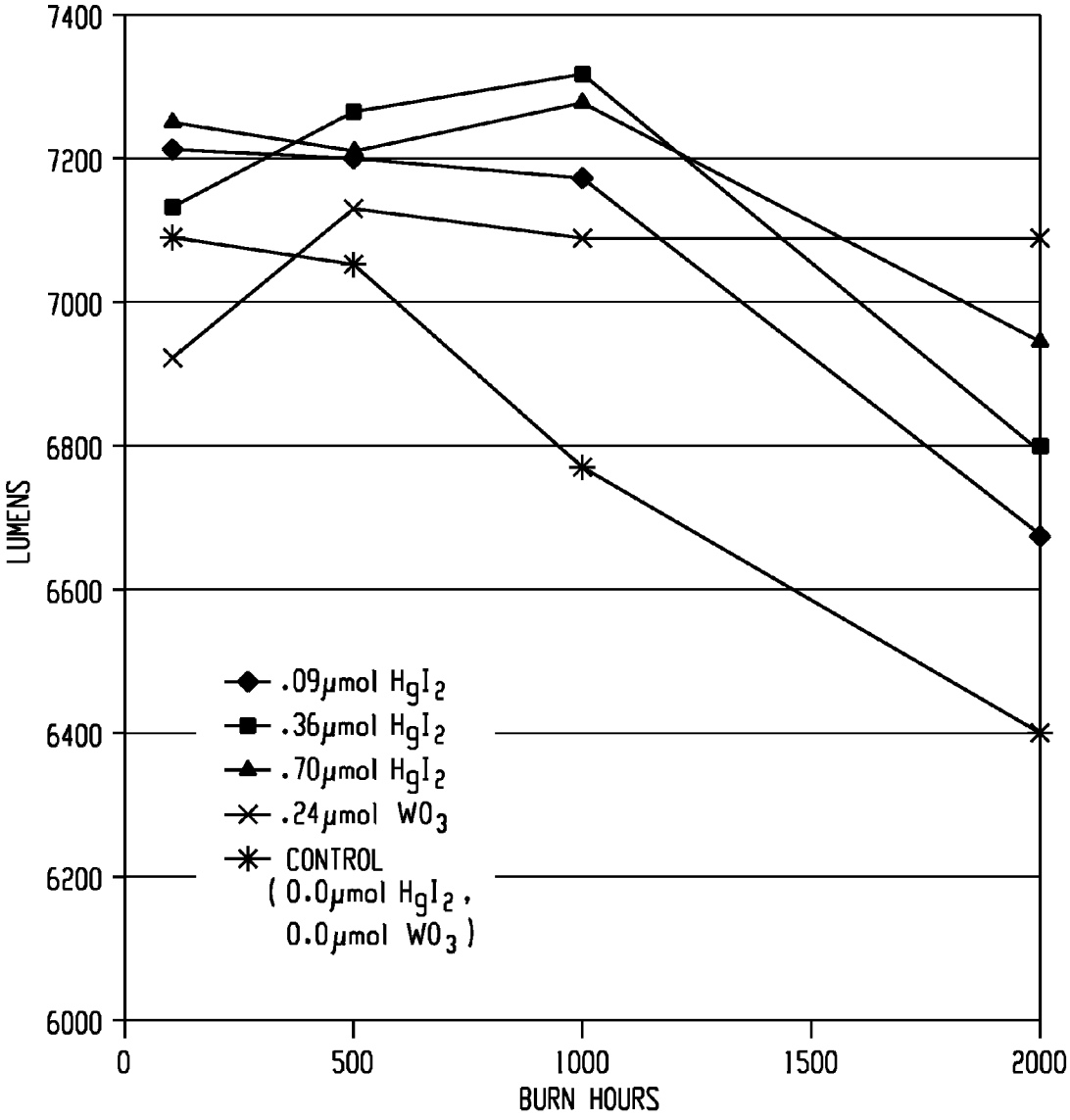
FIG. 8 shows the lumen output of lamps formed with various levels of $HgI_2$ and $WO_3$ over 2000 hours; and, FIG. 9 shows the lumen maintenance expressed as a percent (LM %) for these lamps.
Figure 9:
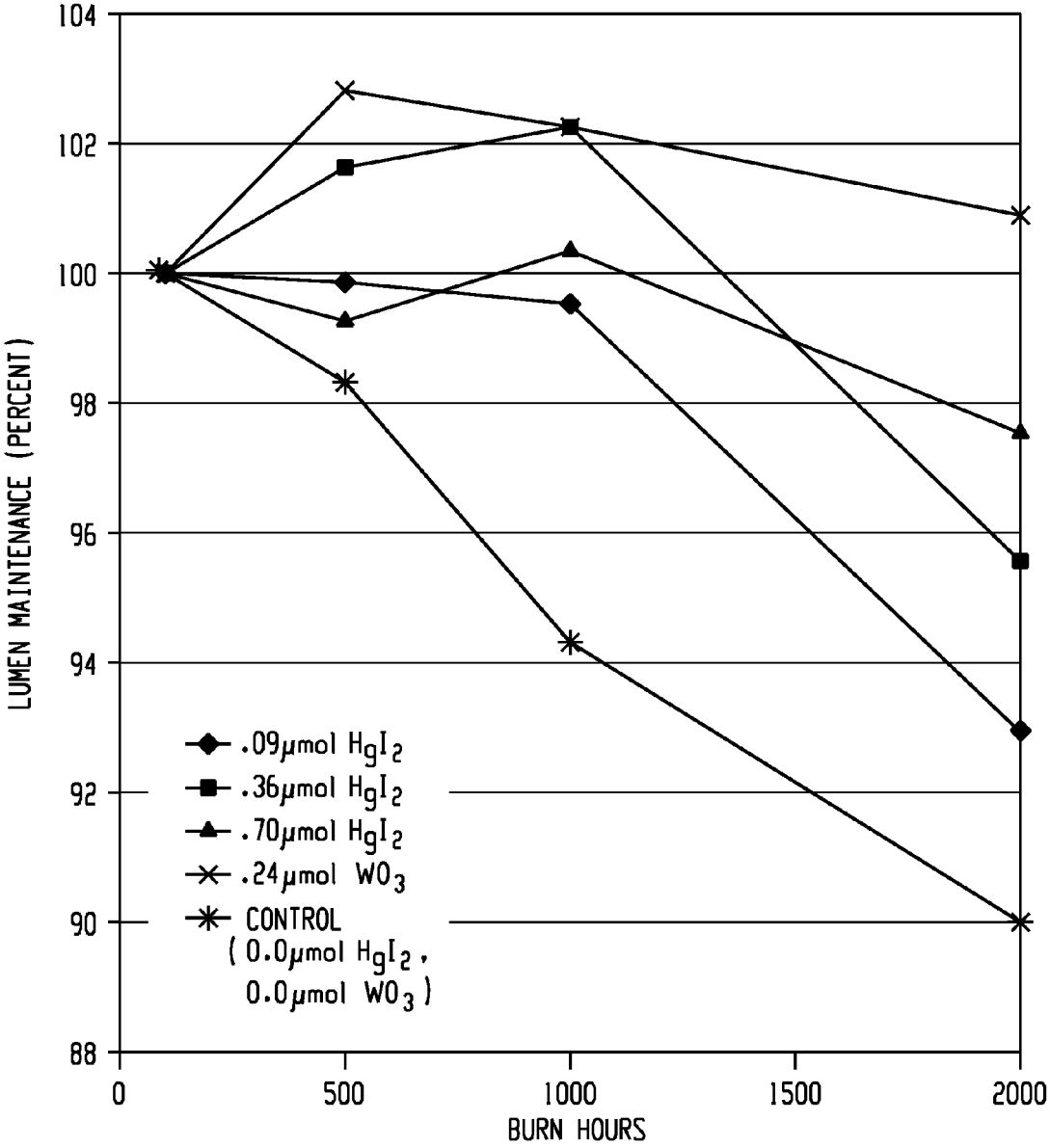

FIGS. 8 and 9 illustrate the effects of $HgI_2$ and $WO_3$ on lumen maintenance in these lamps. FIG. 8 plots the lumen output vs. burning hours while FIG. 9 shows the range in lumen output as a percentage of the initial lumen output. As can be seen from FIGS. 8 and 9, the control sample showed a drop in lumens and lumen percentage over the test while the exemplary lamps B, C, D, and F exhibited a much improved lumen maintenance.

The invention has been described with reference to the preferred embodiments. Obviously, modifications and alterations will occur to others upon reading and understanding the preceding detailed description. It is intended that the invention be construed as including all such modifications and alterations.

What is claimed is:

1. A lamp comprising:

a discharge vessel;

tungsten electrodes extending into the discharge vessel;

an ionizable fill sealed within the vessel, the fill comprising:

a buffer gas, optionally mercury, and a halide component comprising a rare earth halide selected from the group consisting of lanthanum halides, praseodymium halides, neodymium halides, samarium halides, cerium halides, and combinations thereof; and wherein the fill is free of all rare earth halides other than halides of lanthanum, praseodymium, neodymium, samarium, and cerium;

a source of available oxygen in the discharge vessel, the rare earth being present in an amount such that, during lamp operation, in combination with the source of available oxygen, it maintains a difference in vapor phase solubility for tungsten species between a wall of the discharge vessel and at least a portion of at least one of the electrodes.

2. The lamp of claim 1, wherein the fill includes metallic mercury.

3. The lamp of claim 1, wherein the source of available oxygen, under the lamp operating conditions, decomposes to form available oxygen.

4. The lamp of claim 3, wherein the source of available oxygen comprises a solid metal oxide.

5. The lamp of claim 1, wherein the source of available oxygen comprises an oxide of tungsten, the oxide of tungsten comprising $WO_3$, and wherein the tungsten oxide is scaled in the vessel in a sufficient amount to maintain a concentration of $WO_2X_2$ vapor phase in the fill during lamp operation of at least $1\times10^{-9}$ μmol/$cm^3$, where X is selected from Cl, Br, and I.

6. The lamp of claim 5, wherein the tungsten oxide is present in the fill at a concentration, expressed in terms of $O_2$ content, of at least 0.1 micromoles/$cm^3$.

7. The lamp of claim 5, wherein the tungsten oxide is present in the fill at a concentration, expressed in terms of $O_2$ content, of from 0.2-3.0 micromoles/$cm^3$.

8. The lamp of claim 1, wherein the rare earth halide comprises cerium halide.

9. The lamp of claim 1, wherein the rare earth halide is present in the fill at a total concentration of from 3 to 13 μmol/$cm^3$.

10. The lamp of claim 1, wherein the fill is free of halides of holmium, thulium, dysprosium, erbium, lutetium, yttrium, and ytterbium, terbium, scandium, and magnesium.

11. The lamp of claim 1, wherein fill further includes at least one of the group consisting of an alkali metal halide, an alkaline earth metal halide other than Mg, and a halide of Tl or In.

12. The lamp of claim 1, where during lamp operation, the fill includes $WO_2X_2$ in vapor form, where X is selected from Cl, Br and I.

13. The lamp of claim 1, where during lamp operation, the wall is at a temperature that is at least 200K lower than the portion of the electrode.

14. The lamp of claim 13, wherein during lamp operation, the wall is at a temperature that is no more than 800K lower than the portion of the electrode.

15. The lamp of claim 1, wherein in operation, the temperature adjacent at least the portion of one of the electrodes is higher than a temperature at which the solubility of tungsten in the vapor phase is at a minimum and a temperature at the wall of the discharge vessel is higher than the temperature at which the solubility of tungsten in the vapor phase is at the minimum.

16. A lamp comprising:
- a discharge vessel;
- tungsten electrodes extending into the discharge vessel;
- an ionizable fill sealed within the vessel, the fill comprising:
  - a buffer gas,
  - optionally mercury,
  - a halide component comprising a rare earth halide selected from the group consisting of lanthanum halides, praseodymium halides, neodymium halides, samarium halides, cerium halides, and combinations thereof, and wherein the fill is free of all rare earth halides other than halides of lanthanum, praseodymium, neodymium, samarium, and cerium,
  - and at least one of the group consisting of: a) an alkali metal halide, b) an alkaline earth metal halide, other than magnesium, and c) a halide of an element selected from indium and thallium, the lamp fill being free of halides of holmium, thulium, dysprosium, erbium, lutetium, yttrium, and ytterbium, terbium, scandium, and magnesium, and
  - tungsten oxide sealed in the vessel in a sufficient amount to maintain a concentration of $WO_2X_2$ in a vapor phase in the fill during lamp operation of at least $1\times10^{-9}$ μmol/$cm^3$, where X is selected from Cl, Br, and I.

17. The lamp of claim 16, wherein the tungsten oxide is $WO_3$.

18. A method of forming a lamp comprising:
- providing a discharge vessel;
- providing tungsten electrodes which extend into the discharge vessel;
- sealing an ionizable fill within the vessel, the fill comprising:
  - a buffer gas,
  - optionally free mercury,
  - a halide component comprising a rare earth halide selected from the group consisting of lanthanum halides, praseodymium halides, neodymium halides, samarium halides, cerium halides, and combinations thereof; and
- providing a source of available oxygen in the discharge vessel, the rare earth halide being selected in type to form an unstable oxide and being present in an amount such that, during lamp operation, in combination with the source of available oxygen, the solubility of tungsten species in the fill is lower adjacent at least a portion of one of the electrodes than at a wall of the discharge vessel, such that tungsten from the electrode that would otherwise be deposited on the wall during lamp operation is transported back to the electrode.

19. A method of operating a lamp comprising:
- providing a lamp comprising:
  - a discharge vessel;
  - tungsten electrodes extending into the discharge vessel;
  - an ionizable fill sealed within the vessel, the fill comprising:
    - a buffer gas,
    - optionally mercury, and
    - a halide component comprising a rare earth halide selected from the group consisting of lanthanum halides, praseodymium halides, neodymium halides, samarium halides, cerium halides, and combinations thereof; and
    - wherein the fill is free of all rare earth halides other than halides of lanthanum, praseodymium, neodymium, samarium, and cerium; and
  - a source of available oxygen in the discharge vessel comprising a tungsten oxide, the rare earth being present in an amount such that, during lamp operation, in combination with the source of available oxygen, it maintains a difference in vapor phase solubility for tungsten species between a wall of the discharge vessel and at least a portion of at least one of the electrodes; and
- operating the lamp by supplying an alternating current to the lamp to generate a discharge in the lamp vessel, the available oxygen reacting with tungsten deposited on the wall of the vessel to generate a soluble tungsten species, the soluble tungsten species being deposited on the electrodes.

20. The method of claim 19, wherein, during lamp operation, the temperature adjacent at least the portion of one of the electrodes is higher than a temperature at which the solubility of tungsten in the vapor phase is at a minimum and a temperature at the wall of the discharge vessel is higher than the temperature at which the solubility of tungsten in the vapor phase is at the minimum.

21. The method of claim 18, wherein, during lamp operation, the temperature adjacent at least the portion of one of the electrodes is higher than a temperature at which the solubility of tungsten in the vapor phase is at a minimum and a temperature at the wall of the discharge vessel is higher than the temperature at which the solubility of tungsten in the vapor phase is at the minimum.

* * * * *